US012234198B2

(12) United States Patent
Mohler et al.

(10) Patent No.: US 12,234,198 B2
(45) Date of Patent: Feb. 25, 2025

(54) PASSIVATED FUEL

(71) Applicant: Spectre Enterprises, Inc., Melbourne, FL (US)

(72) Inventors: Timothy Mohler, Melbourne, FL (US); Daniel Yates, Melbourne, FL (US)

(73) Assignee: Spectre Enterprises, Inc., Melbourne, FL (US)

( * ) Notice: Subject to any disclaimer, the term of this patent is extended or adjusted under 35 U.S.C. 154(b) by 823 days.

(21) Appl. No.: 17/394,115

(22) Filed: Aug. 4, 2021

(65) Prior Publication Data

US 2022/0041523 A1 Feb. 10, 2022

Related U.S. Application Data

(60) Provisional application No. 63/061,377, filed on Aug. 5, 2020.

(51) Int. Cl.
*C06B 45/14* (2006.01)

(52) U.S. Cl.
CPC ..... *C06B 45/14* (2013.01)

(58) Field of Classification Search
None
See application file for complete search history.

(56) References Cited

U.S. PATENT DOCUMENTS 2,131,352 A 9/1938 Marsh
2,239,123 A 4/1941 Stoneking
2,995,429 A 8/1961 Williams et al.
2,995,431 A 8/1961 Bice
3,122,884 A 3/1964 Grover et al.
3,155,749 A 11/1964 Rossen et al.
3,170,402 A 2/1965 Morton et al.
3,275,259 A 9/1966 Plungulan
3,382,117 A 5/1968 Cook
(Continued)

FOREIGN PATENT DOCUMENTS

GB 885409 A 12/1961
GB 987332 A 3/1965
(Continued)

OTHER PUBLICATIONS

Jesse J. Sabatini, Amita V. Nagori, Gary Chen, Phillip Chu, Reddy Damavarapu, and Thomas M. Klapotke, High-Nitrogen-Based Pyrotechnics: Longer- and Brighter-Burning, Perchlo.
(Continued)

*Primary Examiner* — Aileen B Felton
(74) *Attorney, Agent, or Firm* — Lang Patent Law LLC; William F. Lang, IV

(57) ABSTRACT

A non-self-passivating fuel such as boron or magnesium is protected from exposure to oxygen sources by a self-passivating fuel layer such as aluminum or titanium. When the non-self-passivating fuel is utilized within a layered structure of alternating fuel and oxygen source layers, self-passivating fuel layers located between each non-self-passivating fuel layer and each oxygen source layer. The self-passivating fuel oxidizes until self-passivation is reached, protecting the non-self-passivating fuel from oxidation. Any of the non-self-passivating fuel which does not oxidize is available for use as fuel in any fuel-oxygen source reaction.

11 Claims, 2 Drawing Sheets

(56) References Cited

U.S. PATENT DOCUMENTS

| | | | |
|---|---|---|---|
| 3,668,872 | A | 6/1972 | Camp et al. |
| 3,711,344 | A | 1/1973 | Pierce |
| 3,715,248 | A | 2/1973 | Swotinsky et al. |
| 3,725,516 | A | 4/1973 | Kaufman |
| 3,794,545 | A | 2/1974 | Bertrand et al. |
| 3,808,061 | A | 4/1974 | Pierce |
| 3,896,731 | A | 7/1975 | Kilmer |
| 3,896,865 | A | 7/1975 | Comfort et al. |
| 3,905,846 | A | 9/1975 | Berta |
| 3,938,440 | A | 2/1976 | Dooley et al. |
| 3,956,890 | A | 5/1976 | Davis |
| 3,962,865 | A | 6/1976 | McCone, Jr. |
| 3,995,559 | A | 12/1976 | Bice et al. |
| 4,013,743 | A | 3/1977 | Blasche, Jr. et al. |
| 4,115,999 | A | 9/1978 | Diebold |
| 4,475,461 | A | 10/1984 | Durrell |
| 4,615,270 | A | 10/1986 | Bell |
| 4,651,254 | A | 3/1987 | Brede et al. |
| 4,756,251 | A | 7/1988 | Hightower, Jr. et al. |
| 4,823,699 | A | 4/1989 | Farinacci |
| 4,823,701 | A | 4/1989 | Wilhelm |
| 4,875,948 | A | 10/1989 | Verneker |
| 4,996,922 | A | 3/1991 | Halcomb |
| 5,030,301 | A | 7/1991 | Stout et al. |
| 5,076,868 | A | 12/1991 | Doll et al. |
| 5,080,017 | A | 1/1992 | Asikainen |
| 5,237,927 | A | 8/1993 | Gonzalez et al. |
| 5,266,132 | A | 11/1993 | Danen et al. |
| 5,320,043 | A | 6/1994 | Andre et al. |
| 5,322,018 | A | 6/1994 | Hadden et al. |
| 5,363,768 | A | 11/1994 | Solberg et al. |
| 5,589,661 | A | 12/1996 | Menke et al. |
| 5,721,392 | A | 2/1998 | Chan et al. |
| 5,773,748 | A | 6/1998 | Makowiecki et al. |
| 5,801,325 | A | 9/1998 | Willer et al. |
| 5,817,970 | A | 10/1998 | Feierlein |
| 5,854,439 | A | 12/1998 | Almstrom et al. |
| 6,158,348 | A | 12/2000 | Campoli |
| 6,176,950 | B1 | 1/2001 | Wood et al. |
| 6,183,569 | B1 | 2/2001 | Mohler |
| 6,334,394 | B1 | 1/2002 | Zimmermann et al. |
| 6,363,853 | B1 | 4/2002 | Rohr |
| 6,364,975 | B1 | 4/2002 | Fleming et al. |
| 6,599,379 | B2 | 7/2003 | Hiskey et al. |
| 6,679,960 | B2 | 1/2004 | Jones |
| 6,692,655 | B1 | 2/2004 | Martins et al. |
| 6,712,917 | B2 | 3/2004 | Gash et al. |
| 6,740,180 | B1 | 5/2004 | Cesaroni |
| 6,805,832 | B2 | 10/2004 | Mohler et al. |
| 6,843,868 | B1 | 1/2005 | Fawls et al. |
| 6,962,112 | B1 | 11/2005 | Kern |
| 7,770,380 | B2 | 8/2010 | Dulligan et al. |
| 7,886,668 | B2 | 2/2011 | Hugus et al. |
| 7,896,988 | B2 | 3/2011 | Mohler |
| 7,918,163 | B2 | 4/2011 | Dahlberg |
| 7,955,451 | B2 | 6/2011 | Hugus et al. |
| 7,958,823 | B2 | 6/2011 | Sawka |
| 7,998,290 | B2 | 8/2011 | Sheridan et al. |
| 8,202,377 | B2 | 6/2012 | Erickson et al. |
| 8,298,358 | B1 | 8/2012 | Coffey et al. |
| 8,454,769 | B2 | 6/2013 | Erickson et al. |
| 8,465,608 | B1 * | 6/2013 | Coffey ..... C06B 45/14 149/109.2 |
| 8,524,018 | B2 | 9/2013 | Busky et al. |
| 8,544,387 | B2 | 10/2013 | Dahlberg |
| 8,591,676 | B2 | 11/2013 | Coffey et al. |
| 8,641,842 | B2 | 2/2014 | Hafner et al. |
| 9,464,874 | B1 | 10/2016 | Mohler et al. |
| 9,709,366 | B1 | 7/2017 | Mohler et al. |
| 9,816,792 | B1 | 11/2017 | Mohler et al. |
| 10,254,090 | B1 | 4/2019 | Mohler et al. |
| 10,415,938 | B2 | 9/2019 | Mohler et al. |
| 2006/0011276 | A1 | 1/2006 | Grix et al. |
| 2006/0278119 | A1 | 12/2006 | Shilliday et al. |
| 2007/0169862 | A1 | 7/2007 | Hugus et al. |
| 2007/0272112 | A1 | 11/2007 | Nielson et al. |
| 2008/0047453 | A1 | 2/2008 | Dahlberg |
| 2008/0134924 | A1 | 6/2008 | Sawka |
| 2008/0202373 | A1 * | 8/2008 | Hugus ..... F42B 12/44 102/506 |
| 2009/0139422 | A1 | 6/2009 | Mohler |
| 2010/0032064 | A1 * | 2/2010 | Dreizin ..... C06B 43/00 149/37 |
| 2010/0193093 | A1 | 8/2010 | Coffey et al. |
| 2010/0251694 | A1 | 10/2010 | Hugus et al. |
| 2010/0282115 | A1 | 11/2010 | Sheridan et al. |
| 2011/0067789 | A1 | 3/2011 | Grix et al. |
| 2011/0259230 | A1 | 10/2011 | Sawka et al. |
| 2011/0308416 | A1 | 12/2011 | Bar et al. |
| 2012/0103479 | A1 | 5/2012 | Katzakian et al. |
| 2012/0132096 | A1 | 5/2012 | Chin et al. |
| 2013/0305950 | A1 | 11/2013 | Coffman, II |
| 2016/0102030 | A1 | 4/2016 | Coffey et al. |
| 2020/0232772 | A1 | 7/2020 | Coffey et al. |

FOREIGN PATENT DOCUMENTS

| | | | |
|---|---|---|---|
| GB | 994184 | A | 6/1965 |
| WO | WO 2005/121055 | A1 | 12/2005 |

OTHER PUBLICATIONS

Marc Comet et al., Boron as Fuel for Ceramic Thermites (Abstract), Feb. 2014, https://pubs.acs.org/doi/10.1021/ef500221p.

Electroactive Polymers, Wikipedia, https://en.wikipedia.org/wiki/Electroactive_polymers, dated prior to the provisional application filing date.

Evaporation (deposition), Wikipedia, https://en.wikipedia.org/wiki/Evaporation_(deposition), dated prior to the provisional application filing date.

Passivation (chemistry), Wikipedia, https://en.wikipedia.org/wiki/Passivation_(chemistry), dated prior to the provisional application filing date.

Physical vapor deposition, Wikipedia, https://en.wikipedia.org/wiki/Physical_vapor_deposition, ated prior to the provisional application filing date.

What is Thin Film Deposition by Thermal Evaporation?, Semicore Equipment, Inc., 2020, http://www.semicore.com/news/71-thin-film-deposition-thermal-evaporation.

Weighing the Benefits of Sputtering v. Evaporation, Denton Vacuum, 2020, https://www.dentonvacuum.com/weighing-the-benefits-of-sputtering-vs-evaporation/.

International Search Report and Written Opinion of the International Searching Authority for PCT/US21/44566, mailed Nov. 10, 2021.

* cited by examiner

PASSIVATED FUEL

CROSS REFERENCE TO RELATED APPLICATION

This application claims the benefit of U.S. provisional patent application Ser. No. 63/061,377, which was filed on Aug. 5, 2020, and entitled "Passivated Metal Fuel."

TECHNICAL FIELD

The present invention relates to ignitable metal fuels. More specifically, a non-self-passivating fuel having self-passivating metal fuel layers between the non-self-passivating metal fuel and oxygen source layers is provided.

BACKGROUND INFORMATION

Various fuel and oxidizer combinations have been known, but in some instances are limited by the reactivity of the fuels. Aluminum is a commonly used metal fuel, partly due to its self-passivating nature. Aluminum will typically form a thin oxide layer on its surface, and will discontinue oxidizing once this passivation layer is formed. However, other desirable metal fuels, for example, magnesium and boron, are prone to self-oxidizing when placed in contact with a source of oxygen or an oxidizer, and are not self-passivating. Instead, magnesium and boron may continue to oxidize until a non-trivial or perhaps substantial portion of the magnesium or boron which is present has been oxidized. For example, magnesium will oxidize to a thickness of about 4 nm when exposed to dry room temperature air, but can oxidize to as much as 50 nm thick or more when exposed to elevated temperatures or humidity.

Some presently known metal fuels rely on the inherent oxidation of the fuel itself, which forms a metal oxide layer on their surface during or after deposition, to passivate the fuel, thereby resisting further oxidation of the fuel. One example is U.S. Pat. No. 5,266,132, which was issued to W. C. Danen et al. on Nov. 30, 1993. Such metal oxide interface layers contribute nothing to the ignition reaction. Their presence within the overall fuel structure combined with their lack of participation in the ignition reaction reduces the energy density of the fuel. When particularly thin fuel layers are used, the formation of these oxide surface layers could potentially consume a significant percentage of the available fuel, making the oxidized fuel unavailable for ignition and considerably reducing the energy density of the fuel. Thus, reliance on the formation of an oxide at the interface between a metal fuel and an oxidizer not only limits the choice of fuels to self-passivating fuels, but also places a minimum limit on the thickness of the fuel layers. Given equal amounts of fuel and oxidizer, a greater number of thinner layers results in faster ignition. However, to the extent that the fuel is oxidized prior to ignition, the oxidized fuel is unavailable for the ignition reaction. Thinner layers of fuel result in oxidation of a greater portion of the fuel, reducing the energy density of the ignition reaction. Thus, fuel selection is limited to those which will self-passivate before a significant amount of the fuel becomes oxidized.

FIG. 1 illustrates the relationship between the fuel size and the lost volume due to oxidation. As this figure demonstrates, a smaller fuel size, such as thinner layers of fuel, result in a greater percentage of that fuel being lost to oxidation during or after deposition of the fuel and oxide layers.

Deposition techniques which resist the formation of oxide at the interface between a fuel layer and oxide layer include U.S. Pat. No. 8,298,358, issued to Kevin R. Coffey et al. on Oct. 30, 2012, and U.S. Pat. No. 8,465,608, issued to Kevin R. Coffey et al. on Jun. 18, 2013, and the entire disclosure of both patents is expressly incorporated herein by reference. These techniques rely on sputtering chamber pressures of $10^{-8}$ Torr or perhaps $6\times10^{-9}$ Torr. When such chamber pressures are attainable, these methods have been shown to produce excellent results. Many typical production systems maintain a pressure of $10^{-5}$ or $10^{-6}$ Torr, so other means of resisting oxidation of the fuel are desirable when limited to such systems.

Accordingly, there is a need for a self-passivating metal fuel layer that resists oxidation of a non-self-passivating fuel without reducing the energy density of the overall fuel structure. A self-passivating metal fuel layer which could potentially be available itself as fuel would protect the primary, non-self-passivating fuel without causing an appreciable effect on the energy density of the fuel.

SUMMARY

The above needs are met by a fuel. The fuel comprises a non-self-passivating fuel and an oxygen source. The fuel further comprises a self-passivating metal fuel disposed between the non-self-passivating fuel and the oxygen source.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
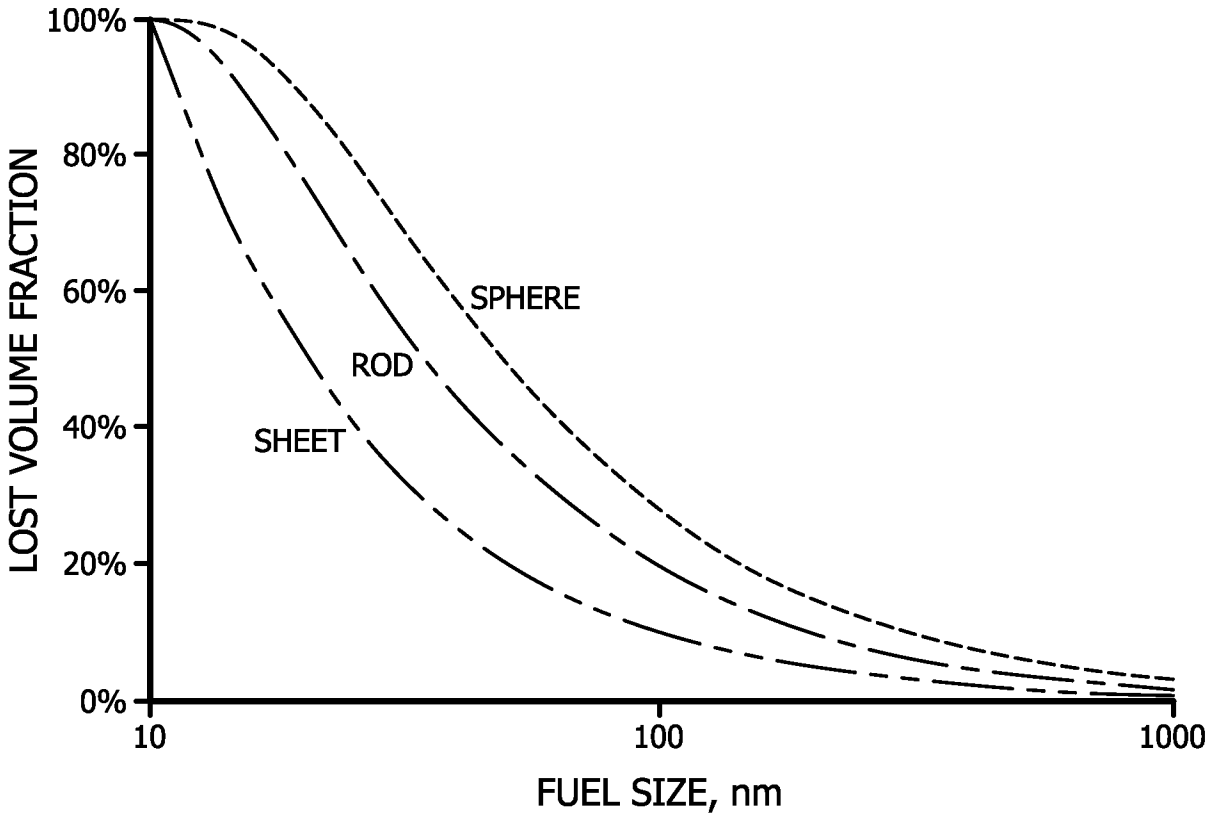
FIG. 1 is a graph showing the relationship between fuel size and volume lost due to surface oxidation, comparing a sphere, rod, and sheet.
Figure 2:
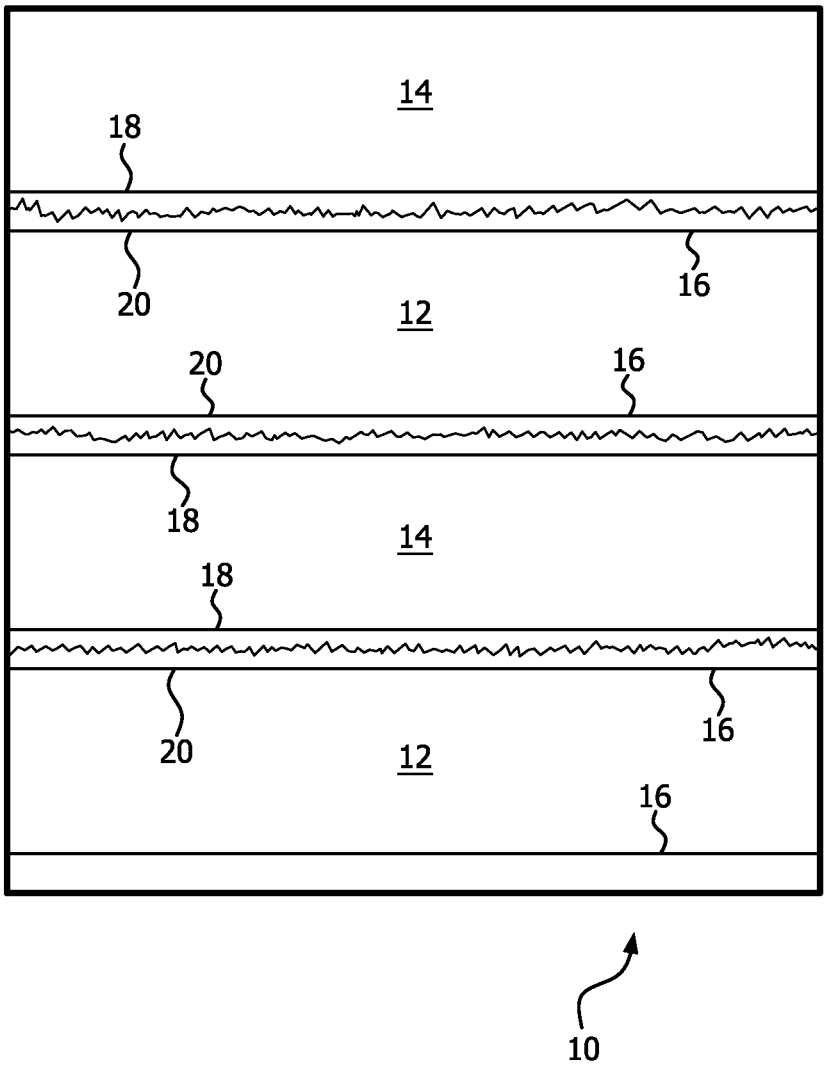
FIG. 2 is a cross sectional side elevational view of a passivated fuel structure.

Referring to FIG. 2, a fuel 10 which includes a passivated fuel is illustrated. The fuel 10 includes one or more non-self-passivating fuel layers 12 and one or more oxygen source layers 14. Each of the fuel layers 12 includes a self-passivating fuel layer 16 disposed on either side of the non-passivating fuel layer 12. As used herein, a self-passivating fuel layer is defined as a layer of material which, when in contact with an oxygen source layer, will react with the oxygen from the oxygen source layer to form an oxide, and will discontinue forming the oxide before the self-passivating fuel layer is completely oxidized, thereby protecting the non-self-passivating fuel layer from oxidation from the oxygen source layer. The portion of the non-self-passivating fuel layer which remains unoxidized remains available as fuel for an ignition reaction with the oxidation layer. Unlike a simple insulating layer, a self-passivating fuel layer thus contributes to the reaction between the non-self-passivating fuel layer and oxide layer by serving as fuel, rather than simply insulating the non-self-passivating fuel layer from the oxygen source layer. An oxygen source layer can be an oxidizer layer such as a metal oxide, or another oxygen source such as a polymer or a single base (nitrocellulose) or double base (nitrocellulose and nitroglycerin) smokeless propellant. In some examples, self-passivating metal fuel 16 is deposited on a polymer 14 substrate such as nitrocellulose, a combination of nitrocellulose and nitroglycerin, or another polymer, followed by a non-passivating fuel 12 and another self-passivating fuel layer 16. Although a layered structure is illustrated in FIG. 2, as used herein, a layered structure may include a single layer of non-passivating fuel 12 as well as a single layer of an oxygen source 14, regardless of whether the single layer of oxygen source 14 forms a substrate or a deposited layer.

Each of the fuel layers 12 is a non-self-passivating fuel, for example, magnesium or boron. In the illustrated example, each of the non-self-passivating fuel layers 12 has a thickness ranging from about 10 nm thick to about 50 nm thick, although larger or smaller thicknesses may be used depending on the specific fuel and oxygen source materials selected as well as the desired reaction rate. In the illustrated example, each of the oxygen source layers 14 is shown having a thickness that is similar to the thickness of the non-self-passivating fuel layers 12. The exact thicknesses of the non-self-passivating fuel layers 12 and oxygen source layers 14, both in absolute terms and relative to each other, will depend on the amount of fuel and oxygen source that are necessary to substantially fully utilize both the fuel and the oxygen source, and will vary depending on the materials selected. In the illustrated example, the oxygen source layers 14 may be a metal oxide, for example, CuO. Alternatively, the oxygen source layer 14 may be a polymer that is capable of supplying oxygen for the ignition of the fuel layer 12. Some examples of the layer 14 may be made from a dielectric polymer. A polymer layer 14 could also be selected to introduce nitrogen during ignition, thus lowering the flame temperature.

Other examples of oxygen source layer 14 could be made from nitrocellulose, or a combination of nitrocellulose and nitroglycerin, for example, any such combination used for double base smokeless gunpowder. Each of these materials will burn on its own when ignited, and will also react with the non-passivated metal fuel layer 12 when ignited. In the example of a single base propellant, magnesium will react with nitrocellulose as follows:

$$3Mg+2C_6H_{10}O_{10}N_3 \rightarrow 3MgO+6H_2O+3N_2+12CO$$

Thus, an example combination of magnesium and single base propellant, disregarding the polymer and the protective coating 6, should consist of about 10.9% magnesium and 89.1% nitrocellulose, +/−2% (excluding the self-passivating layer 16).

In the example of a double base propellant, disregarding the polymer, magnesium will react with nitrocellulose as shown above, and will react with nitroglycerin as follows:

$$2C_3H_5N_3O_9+7Mg \rightarrow 6CO+5H_2O+3N_2+7MgO$$

Thus, an example combination of magnesium and double base propellant, based on a double base propellant having about 40% nitroglycerin, would include about 13% magnesium, 52% nitrocellulose, and 35% nitroglycerin (excluding the self-passivating layer 16). Double base propellants having different proportions of nitrocellulose and nitroglycerin may be used, with the percentages of nitrocellulose, nitroglycerin, and magnesium varying accordingly. Other burnable metals, for example, boron, will react similarly during ignition of the propellant, so the portions of ingredients for other variations of the propellant, such as those using boron, can be similarly determined.

The layers 16 are made from a self-passivating metal fuel. The illustrated example of the self-passivating fuel layers 16 are made from aluminum or titanium. In the illustrated example, the self-passivating fuel layers 16 are about 2 nm to about 5 nm thick, although larger or smaller thicknesses could be used. Because aluminum and titanium are self-passivating, the passivation layers 16 will oxidize to the point of self-passivation, and then resist further oxidation, thereby protecting the non-self-passivating fuel layers 12 from oxidation prior to ignition of the fuel structure 10. Any aluminum or titanium that remains unoxidized remains available as fuel, and will react with the oxygen source layer 14 during an ignition reaction.

As one example, in the case of an oxygen source layer 14 made from CuO and fuel layer 12 made from Mg, the chemical reaction is $CuO+Mg \rightarrow Cu+MgO+heat$. The reaction therefore requires one mole of CuO, weighing 79.5454 grams/mole, for every one mole of Mg, weighing 24.305 grams/mole. CuO has a density of 6.315 g/cm$^3$, and magnesium has a density of 1.74 g/cm$^3$. Therefore, the volume of CuO required for every mole is 12.596 cm$^3$. Similarly, the volume of Mg required for every mole is 13.968 cm$^3$. Therefore, within the illustrated example, each oxygen source layer 14 is about the same thickness or slightly thinner than the corresponding fuel layer 12. If aluminum is used for the passivation layer 16, then a small amount of excess CuO can be provided to react with the un-oxidized portion of the aluminum. The amount of excess CuO is determined by the amount of excess aluminum expected to be present to react with CuO according to $3CuO+2Al \rightarrow 3Cu+Al_2O_3+heat$. If other oxygen sources and fuels are selected, then the relative thickness of the oxygen source layer 14 and fuel layer 12 can be similarly determined.

The layers 12, 16, and possibly 14 (depending on the oxygen source selected) can be deposited using the methods described within U.S. Pat. No. 8,298,358, issued to Kevin R. Coffey et al. on Oct. 30, 2012, and U.S. Pat. No. 8,465,608, issued to Kevin R. Coffey et al. on Jun. 18, 2013, and the entire disclosure of both patents is expressly incorporated herein by reference. Dr. Coffey's methods permit the non-self-passivating fuel layers as well as the self-passivating fuel layers deposited using those methods to be either substantially free of oxide (not having a measurable amount of oxide), or if metal oxides of the fuel are present, then the metal oxide layer formed from the fuel will have a thickness of less than about 2 nm or less than about 1 nm.

The layers 12, 14, and/or 16 may also be deposited using sputtering, evaporative deposition, physical vapor deposition, or chemical vapor deposition. The presence of the self-passivating layer 16 between the non-self-passivating fuel 12 and oxygen source 14 makes oxidation of a portion of the self-passivating fuel layer 16 acceptable, and ensures that the primary fuel, found in the non-self-passivating layer 12, is protected from oxidation. In some examples, a fuel layer 12 may be deposited on a self-passivating layer 16 that has been deposited on a polymer sheet 14, for example, a nitrocellulose sheet 14 or a sheet 14 made from nitrocellulose and nitroglycerin.

During or after deposition, a portion 18 of the layer 16 which is adjacent to the oxygen source layer 14 may oxidize. Because the material and the thickness of the layer 16 are selected to ensure that the layer 16 will self-passivate prior to the oxidation reaching the fuel layer 12, an unoxidized portion 20 of the layer 16 will remain. This unoxidized portion 20 is available as fuel for an ignition reaction.

As an alternative to a layered fuel structure, other fuel structures may be used. For example, a fuel utilizing granules or pellets of fuel and oxygen source may utilize fuel pellets made from non-self-passivating fuel that is substantially covered by self-passivating fuel. As used herein, substantially covered means that the non-self-passivating fuel is sufficiently covered to resist oxidation by the oxygen source prior to ignition of the fuel.

While not limited to such use, the fuel structure 10 described herein is anticipated to be useful as a propellant or as a payload for munitions, including but not limited to small arms, artillery, and rockets. The fuel 10 can be utilized for applications where high explosives can otherwise be used. The fuel structure is also anticipated to be useful as a primer for firearms and other munitions which use a primer. As another alternative, multiple ignition or detonation points utilizing controlled timing of ignition or detonation may be incorporated into the fuel 10. Specific ignition/detonation timing and control structures and methods are disclosed in U.S. Pat. No. 9,464,874, which was issued to Timothy Mohler et al. on Oct. 11, 2016, U.S. Pat. No. 9,709,366, which was issued to Timothy Mohler et al. on Jul. 18, 2017, U.S. Pat. No. 9,816,792, which was issued to Timothy Mohoer et al. on Nov. 14, 2017, and U.S. Pat. No. 10,254,090, which was issued to Timothy Mohler et al. on Apr. 9, 2019. The entire disclosure of each and every one of these patents is expressly incorporated herein by reference.

The present invention therefore provides a fuel structure that can utilize the advantages of non-self-passivating fuels such as magnesium or boron, while resisting oxidation of those fuels through contact with an adjacent oxygen source. Additionally, the passivation layer itself may also serve as fuel for the ignition reaction.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A fuel, comprising:

a non-self-passivating metal fuel;

an oxygen source; and a self-passivating metal fuel disposed between the non-self-passivating metal fuel and the oxygen source;

whereby the self-passivating fuel oxidizes by reacting with the oxygen source to form a passivation layer, the passivation layer resisting oxidation of the non-self-passivating fuel from the oxygen source until the fuel is ignited.

2. The fuel according to claim 1, wherein:

the fuel has a layered structure;

the non-self-passivating fuel forms at least one layer of the layered structure, the at least one layer of non-self-passivating fuel defining a pair of opposing surfaces;

the oxygen source forms at least one layer of the layered structure; and the self-passivating metal fuel is disposed on each of the opposing surfaces of the non-self-passivating fuel.

3. The fuel according to claim 2, wherein the non-self-passivating metal fuel is boron or magnesium.

4. The fuel according to claim 3, wherein the oxygen source is a metal oxide, a polymer, or a combination thereof.

5. The fuel according to claim 4, wherein the self-passivating metal fuel is aluminum or titanium.

6. The fuel according to claim 1, wherein the non-self-passivating metal fuel is boron or magnesium.

7. The fuel according to claim 6, wherein the oxygen source is a metal oxide, a polymer, or a combination thereof.

8. The fuel according to claim 7, wherein the self-passivating metal fuel is aluminum or titanium.

9. The fuel according to claim 1, wherein the oxygen source is a metal oxide, a polymer, or a combination thereof.

10. The fuel according to claim 1, wherein the self-passivating metal fuel is aluminum or titanium.

11. The fuel according to claim 1, wherein the self-passivating metal fuel substantially covers the non-self-passivating metal fuel.

* * * * *